United States Patent [19]

Faber et al.

[11] 3,961,579

[45] June 8, 1976

[54] DESTRUCTIVE DEVICES

[75] Inventors: Walter Faber, Pionierhohe; Paul Huber, Jettenberg, both of Germany

[73] Assignee: Firma Buck K.G., Germany

[22] Filed: Dec. 14, 1973

[21] Appl. No.: 424,741

[30] Foreign Application Priority Data

Jan. 2, 1973 Germany ..... 2300043

[52] U.S. Cl. ..... 102/90; 102/6; 102/66

[51] Int. Cl.[2] ..... F42B 11/24

[58] Field of Search ..... 102/6, 66, 90, 103

[56] References Cited

UNITED STATES PATENTS

| | | | |
|---|---|---|---|
| 2,391,242 | 12/1945 | Harry | 102/90 |
| 2,558,726 | 7/1951 | Barker | 102/90 |
| 3,144,830 | 8/1964 | De Fries et al. | 102/103 |
| 3,185,018 | 5/1965 | Damon et al. | 86/20 R |
| 3,291,050 | 12/1966 | Ahlert et al. | 102/90 |
| 3,296,967 | 1/1967 | Bounds | 102/90 |
| 3,401,633 | 9/1968 | Allen | 102/90 |
| 3,736,878 | 7/1971 | Gunterman | 102/90 |

*Primary Examiner*—Samuel W. Engle
*Assistant Examiner*—Harold Tudor
*Attorney, Agent, or Firm*—Burns, Doane, Swecker & Mathis

[57] ABSTRACT

A destructive device for the destruction of equipment such as machines, tanks, and tank gun barrels for example, includes a casing, an alumino-thermic mixture carried therein, and an ignition fuse. The mixture is arranged such that, upon ignition, a heat-generating interreaction is produced for a certain reaction period. The casing is arranged to resist being carbonized by the heat generated by such reaction only for a period substantially commensurate with the reaction period. Consequently, the device may be significantly reduced in size and weight. The casing may comprise a low heat-conductive paper material which also serves to maximize the shock resistibility of the device.

6 Claims, 1 Drawing Figure

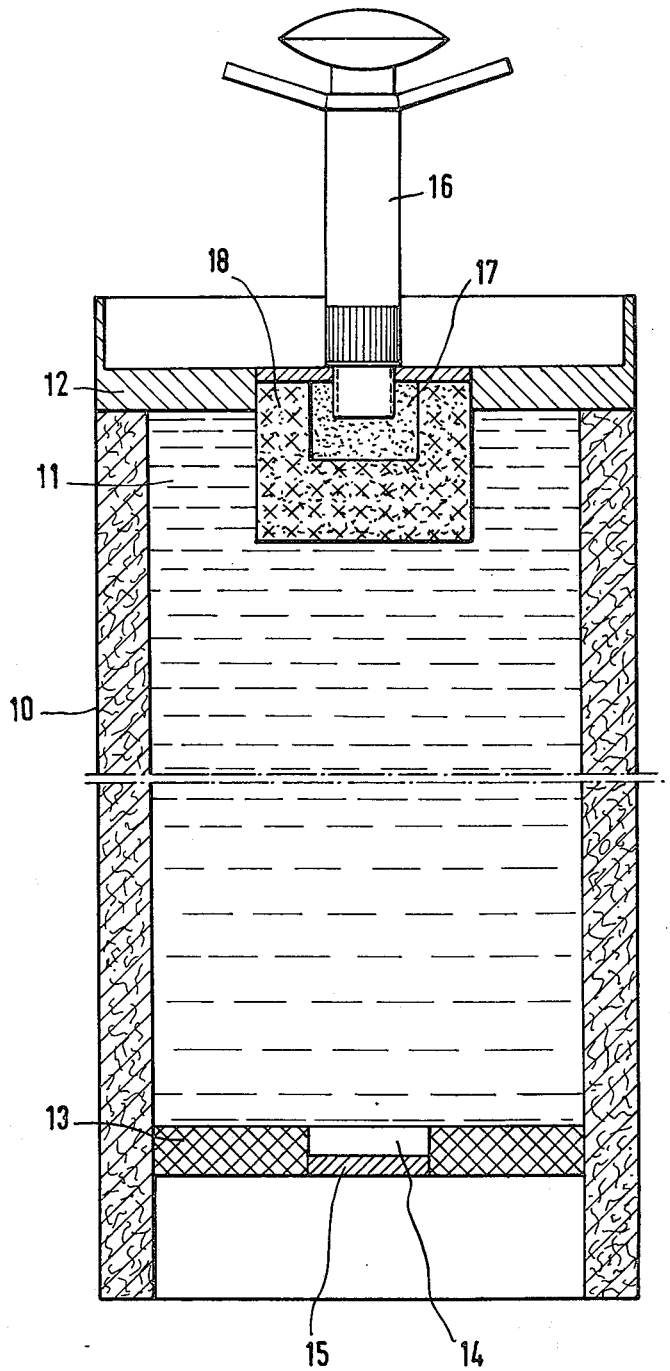
16
18
17
12
11
10
13
15
14

DESTRUCTIVE DEVICES

BACKGROUND AND OBJECTS OF THE INVENTION

The invention relates to an apparatus for the destruction of machines, equipment and tanks, especially gun barrels thereof, comprising a casing filled with an alumino-thermically reacting mixture of substances, which casing has been provided with a fuse and with one or more outlet openings for the highly heated liquid reaction products.

Alumino-thermic arrangements of this type are known from the German Pat. Nos. 1,153,664 and 2,035,737, for example. As compared to the destruction of machines, equipment, tanks and guns by explosive charges, these alumino-thermic destructive devices have the advantage that the destruction takes place in an inconspicous and harmless manner. On the other hand, a disadavantage of these alumino-thermic apparatuses consists in the fact that they are relatively large, heavy and susceptible (sensitive) to shock. The reason for this is that, according to the doctrine explained in the two above mentioned patents, the casing of the device is to consist of a highly fire resistant material or a material with highly fire resistant lining, in order to be able to resist the heat occurring in case of the alumino-thermic reaction. In practice, this has led to the use of casings in the form of ceramic pipes with great wall thickness and of considerable length. For example, in case of a gun barrel caliber of 15 cm, a suitable ceramic pipe may have a length of about 100 cm. Such ceramic pipes have, however, a considerable weight, are unwieldy and are extremely susceptible to breakage in case of shock or drop. At the same time we must point out that the disadvantages of such devices approach a special degree because these devices, in order to be able to use them immediately in case of need, must always be carried along in the tank or with the gun.

A general object of the invention is to minimize or obviate problems of the sort previously discussed.

A primary object of the invention is to provide an alumino-thermic destructive device which is highly compact, i.e., of minimal size and/or weight, and which exhibits improved resistance to shock and drop.

Another related object is to reduce the reaction time of the alumino-thermic mixture of such a device to accommodate a further reduction in size and/or weight.

BRIEF DESCRIPTION OF THE PREFERRED EMBODIMENT OF THE INVENTION

According to the invention at least some of these objects are accomplished through the fact that the casing of the destructive device consists of a carbonizing thin layered material of low heat conductivity, the carbonization time of which exceeds only slightly the reaction time of the alumino-thermic mixture. In this case, the casing is to consist preferably of impregnated, specially agglutinated roll-type paper or of asbestos paper.

The alumino-thermic mixture of substances is preferably designed to have a reaction time considerably below that of such presently known commercial mixtures.

The invention starts out from the realization that it is sufficient for the casing to guarantee or produce heat insulation for the extent of the reaction time of the mixture of substances, and that a short reaction time of the alumino-thermic mixture is acceptable. In case of the prior status of the art on the other hand, the casing has been fabricated of material having such heat resistance that after completion of the reaction time, the casing remains essentially unchanged. Also, the previously utilized commercial alumino-thermic mixture of substances exhibits a reaction time which is comparitively long, assuredly for the purpose of achieving a perfect separation of the slag from the iron melt in the case of the main application purpose of such a mixture, namely for the productive welding together of construction elements. For the present purpose, i.e., the destruction of equipment, however, neither the preservation of the casing nor the separation of iron and slag are of importance. Therefore, in accordance with the invention, the casing can be manufactured of a material which is heat-insulating only during the reaction time, and preferably the reaction time of the destructive mixture is reduced.

These two features then lead to the resulting fact that the casing will have a thinner wall and becomes shorter for the same charge of alumino-thermic mixture of substances. As a result, the weight of the entire device is reduced considerably and its handling is made easier. Thus, in relation to the above mentioned example of a destructive device for a gun barrel of 15 cm caliber, according to the teachings of this invention, a reduction of the casing length to about 50 cm and a saving in weight by about 60 to 70% can be obtained with the use of an alumino-thermic mixture having a reaction time below 10 seconds (the reaction time of previously known commercial mixtures is between 30 and 40 seconds in case of apparatuses of this size). For smaller articles to be destroyed, a reaction time of only three or four seconds can be obtained. Furthermore, the apparatus of the invention is extremely resistant to shock and drop, because of the novel construction of its casing.

In summary, one feature of the present invention involves the construction of the casing of a destructive device such that the carbonization period of the casing, or heat-induced decomposition period, is substantially commensurate with the reaction period of the mixture. In other words, the integrity or unity of the casing is maintained throughout the reaction period but is broken down almost immediately thereafter. In this manner, it is possible to reduce the size and weight of the device. Another related feature of the invention involves the reduction of the reaction time of the alumino-thermic compound which, when realized in conjunction with the teachings of the afore-mentioned feature, accommodates a further reduction in size and weight of the device. Significantly, this reduction in weight and size can be accompanied by an increase in shock resistance of the casing in accordance with the invention.

The reduction of the reaction time of the alumino-thermic compound can be accomplished in various ways, e.g., by a special composition of the mixture, by suitable development and arrangement of the igniter, etc. Another way is to compress the compound. However, it must be pointed out that the compressing of such mixtures in compressing rolls is fraught with difficulties. These difficulties will be overcome, however, according to the invention, by a process for the production of an apparatus of the type explained, and which comprises the filling of a casing with a commercial alumino-thermic mixture and inserting the mixture-containing casing into a pressing tool. The mixture is finally compressed to a molded article by operation of the pressing tool. It has turned out indeed, that the load on the pressing tool is considerably less, whenever the unit consisting of casing and filled-in mixture is inserted into the pressing tool.

THE DRAWING

The drawing shows an embodiment of the invention by way of example; the sole FIGURE shows an apparatus for the destruction of a gun barrel schematically and in longitudinal section.

DETAILED DESCRIPTION OF THE PREFERRED EMBODIMENT

According to the drawing, the preferred destructive device has a casing 10 defining a housing in which there is an alumino-thermic charge 11. The casing 10 is closed at one end by a lid 12 and on the other end by a bottom 13. The bottom 13 has an outflow opening 14, which is covered by an easily melting cover 15. A fuse 16, which may, for example, be a conventional manual friction igniter, penetrates the lid 12 and is disposed within an ignition transmission mass 17. The ignition transmission mass 17 is surrounded by an ignition mass 18. The operation of the fuse is conventional and need not be further discussed.

The basic structure described constitutes the status of the prior art and is not an object or feature of the invention. One characteristic of this invention is the fact that the casing 10 is arranged to last through the reaction period of the alumino-thermic compound and become decomposed almost immediately thereafter.

Thus, the casing may consist of a carbonizing, relatively thin-layered material from 2 to 4 mm having relatively little heat conductivity. The casing material preferably comprises an impregnated, agglutinated roll-type paper selected especially for heat resisting characteristics necessary to endure through the given reaction period of the alumino-thermic mixture being utilized. Sodium silicate is particularly suitable for impregnating. The use of asbestos paper is also acceptable. The paper can, for example, be wound or coiled into a cylindrical or other suitable housing-like configuration. Furthermore, it can be advantageous to construct the casing 10 of several layers whereby the individual layers can consist of the same material or of variable materials. It is apparent, given the teaching of the present invention, i.e., that the integrity of the casing must be maintained to provide sufficient heat insulation during the reaction period of the alumino-thermic mixture, that the type of material, the type and amount of impregnating substance (if used), and the casing wall thickness are among the parameters and characteristics which can be selected by one skilled in the art in order to accomplish this. After completion of this reaction time, however, it is acceptable for the casing to carbonize or be otherwise destroyed. Thus, the above discussed parameters are selected so that the casing will exhibit sufficient heat resistance such that the carbonization period of the casing is substantially co-extensive or commensurate with the reaction period of the mixture.

In practice, this arrangement typically results in the thickness of the wall of the casing 10 amounting at most to about one-third of the thickness of the wall of the hitherto-used ceramic pipes.

Another related characteristic or feature of the invention involves the arrangement wherein the alumino-thermic mixture 11 exhibits a reduced reaction time as compared to commercial mixtures heretofore employed. As a result of such a reduction of the reaction time it is possible to make the walls of the casing even thinner, because the time during which the casing must assure a heat insulation is shorter. It is true that the reduction of the reaction time of the alumino-thermic mixture 11 is made at the expense of effecting a complete separation of iron melt from slag. Such separation, however, is unnecessary and without consequence in the present environment.

The reduction of the reaction time of a alumino-thermic mixture can be accomplished in various ways. For example, a special, i.e., particular selection may be made of the mixing ratio and the grain size of the mixture components, or by the addition of reaction accelerators. Actually, a particularly simple method comprises compressing the alumino thermic mixture to a molded article, because, as has been established in this art, the reaction time of the mixture is a function of the mixture density. It has turned out, however, that the compressing of mixtures of such substances in customary pressing tools causes difficulties, especially in regard to keeping the matrixes clean. According to a process feature of the invention, one therefore proceeds in such a way that first of all the casing 10 is filled with commercial alumino-thermic mixutre. Then the casing containing the mixture is inserted into a pressing tool, whereupon the press die descends into the casing and compresses the mixture. At the same time, preferably a casing is used which has a lining with high gliding capacity (i.e., slippery), such as a lining of graphite paper, to facilitate compression of the mixture. The portion of the casing which is disposed above the compressed mixture can then be removed.

SUMMARY OF MAJOR ADVANTAGES AND SCOPE

As the result of a suitable mutual syntonization or correlation of the casing structure with the reaction time of the alumino-thermic mixture, the devices of the type in question can be made substantially smaller and lighter, while having the same effectiveness. Moreover, the devices are much more breakage-resistant than such known devices. Thus, the possibilities of use of these devices are enlarged considerably.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. An apparatus for the destruction of equipment such as machines, tanks, and tank gun barrels comprising a casing, an alumino-thermically reacting mixture contained within the casing, fuse means for igniting the mixture to produce a heat-generating alumino-thermic reaction, and outlet means for outwardly conducting the hot, liquid-like reaction products of the ignited mixture onto said equipment to be destroyed, the improvement wherein:

said alumino-thermic mixture has a reaction period less than ten seconds;

said casing comprising a reaction-confining protion and an outflow portion;

said outflow portion being formed of a material less heat resistant than said reaction-confining portion so as to discharge said reaction products in a given direction during said reaction while said reaction-confining portion confines said reaction products to discharge in said given direction;

said reaction-confining portion consisting of a heat resistant paper whose heat resistance is selected in relation to the reaction period so that said reaction-confining portion confines said reaction products during the reaction period and decomposes immediately upon completion thereof.

2. Apparatus according to claim 1 wherein said paper comprises asbestos paper.

3. Apparatus according to claim 1 wherein said paper is impregnated with sodium silicate.

4. Apparatus according to claim 1 wherein the reaction period of said alumino thermic mixture is about four seconds.

5. Apparatus according to claim 2 wherein the reaction period of said alumino-thermic mixture is about four seconds.

6. Apparatus according to claim 3 wherein the reaction period of said alumino-thermic mixture is about four seconds.

* * * * *